US009198504B2

(12) United States Patent
McCoy et al.

(10) Patent No.: US 9,198,504 B2
(45) Date of Patent: Dec. 1, 2015

(54) INTEGRATED TOOTHBRUSH, TOOTHPASTE DISPENSER AND HOLDER WITH REFRESH CUP COVER

(76) Inventors: William McCoy, Arlington Heights, IL (US); Quincy McCoy, Arlington Heights, IL (US)

( * ) Notice: Subject to any disclaimer, the term of this patent is extended or adjusted under 35 U.S.C. 154(b) by 363 days.

(21) Appl. No.: 12/778,850

(22) Filed: May 12, 2010

(65) Prior Publication Data

US 2010/0290829 A1 Nov. 18, 2010

Related U.S. Application Data

(60) Provisional application No. 61/177,524, filed on May 12, 2009.

(51) Int. Cl.
*A46B 11/00* (2006.01)

(52) U.S. Cl.
CPC ..... *A46B 11/0024* (2013.01); *A46B 11/0037* (2013.01); *A46B 11/0065* (2013.01); *A46B 11/0089* (2013.01); *A46B 2200/1066* (2013.01)

(58) Field of Classification Search
CPC ..... A46B 11/0024; A46B 11/0037; A46B 2200/1066
USPC ..... 401/155, 152, 268
See application file for complete search history.

(56) References Cited

U.S. PATENT DOCUMENTS

| | | | | |
|---|---|---|---|---|
| 1,400,954 | A * | 12/1921 | Holloway et al. | 401/124 |
| 3,227,165 | A | 1/1966 | Costanza | |
| 4,413,851 | A | 11/1983 | Ritter | |
| 4,826,341 | A * | 5/1989 | Kwak | 401/280 |
| D347,944 | S | 6/1994 | Honora | |
| 5,758,914 | A * | 6/1998 | Ioveno | 292/288 |
| D439,413 | S | 3/2001 | Klein | |
| 6,318,596 | B1 | 11/2001 | Wiesner | |
| D459,585 | S | 7/2002 | Moreno et al. | |
| 7,070,354 | B1 * | 7/2006 | Gutierrez-Caro | 401/277 |
| 7,401,373 | B2 | 7/2008 | Tybinkowski et al. | |
| 7,707,677 | B2 | 5/2010 | Moskovich et al. | |
| 2002/0114658 | A1 | 8/2002 | Allen et al. | |
| 2003/0056307 | A1 | 3/2003 | Tybinkowski et al. | |
| 2003/0150472 | A1 | 8/2003 | Johnson | |
| 2008/0244849 | A1 | 10/2008 | Moskovich et al. | |

* cited by examiner

*Primary Examiner* — David Walczak
*Assistant Examiner* — Bradley Oliver
(74) *Attorney, Agent, or Firm* — Leydig, Voit & Mayer, Ltd.

(57) ABSTRACT

A combination toothbrush and toothpaste dispenser device includes a caddy that accepts tube of toothpaste and guides an integral toothpaste squeezer along a predetermined track. The squeezer is generally wedge-shaped and may be moved parallel and/or inwardly to the axis of the caddy. A modular and detachable toothbrush head mates with the caddy and includes a shaft with a central bore for delivering toothpaste to the toothbrush bristles. A refresh cup is further supplied to store and protect the combination device while not in use.

15 Claims, 16 Drawing Sheets

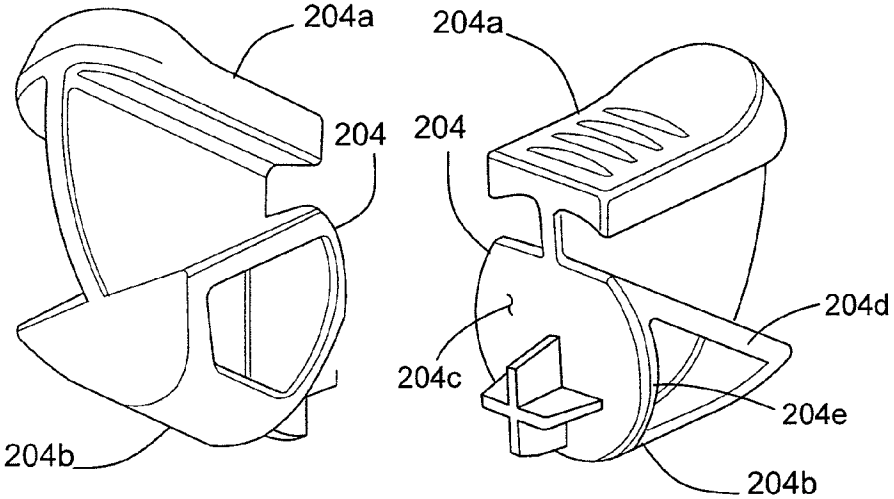
FIG. 38
FIG. 39
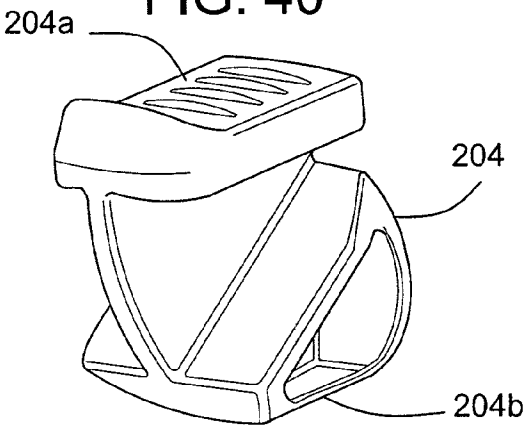
FIG. 40

INTEGRATED TOOTHBRUSH, TOOTHPASTE DISPENSER AND HOLDER WITH REFRESH CUP COVER

CROSS-REFERENCE TO RELATED APPLICATION

This application claims the priority benefit of U.S. Provisional Patent Application Ser. No. 61/177,524, filed on May 12, 2009, entitled "INTEGRATED TOOTHBRUSH, TOOTHPASTE DISPENSER AND HOLDER WITH REFRESH CUP COVER," the contents of which are expressly incorporated herein by reference in their entirety, including any references therein.

BACKGROUND OF THE INVENTION

Toothpaste is typically supplied to consumers in a squeezable tube container. When desired, consumers squeeze the tube to extrude a desired amount of toothpaste onto a toothbrush. After use, the toothbrush and toothpaste are put aside and stored, typically separately, until next required.

Various devices and implements, such as slotted keys or tube "squeezers," assist consumers to dispense toothpaste out of tubes and onto toothbrushes. These devices, like the toothbrush and toothpaste tube, are typically a separate component. When stored in a toothbrush holder, a tooth brushing routine may involve as many as four separate components, i.e., a toothbrush, toothpaste tube, squeezer and holder.

The prior art includes examples of combination toothbrush and toothpaste dispensers. One such example is U.S. Pat. No. 3,227,165 issued to Costanza on Jan. 4, 1966. This patent includes a cylindrical barrel 12 that contains a dentifrice (such as toothpaste) and a sliding plunger 14 for dispensing toothpaste onto a toothbrush via an internal channel in the combination device. The toothpaste may be manually filled into the barrel; alternatively, a custom manufactured barrel, which is "prepacked with toothpaste," may be substituted. ('165 patent at col. 2, ll. 54-62.) The components of the combination device, including the brush, are affixed to each other. Other examples of combination devices include U.S. Pat. D459,585 S issued to Moreno et al. on Jul. 2, 2002; U.S. Pat. D439,413 S issued to Klein on Mar. 27, 2001; and U.S. Pat. D347, 944 issued to Honora on Jun. 21, 1994.

Despite these examples of prior art, there exists a long-felt and ongoing need for a new and improved system for integrating a toothbrush with a toothpaste dispenser and holder as well as a system of supplying toothpaste onto a toothbrush head in an efficient manner. There further exists a need for an integrated unit that may be used hygienically by more than one person.

BRIEF SUMMARY OF THE INVENTION

The preferred embodiments comprise an integrated oral hygiene device, intended for consumer use, including a toothpaste caddy that accepts commonly sold sizes of tubes of toothpaste. The caddy includes a slot that guides a toothpaste squeezer along a predetermined track. In a preferred embodiment, the squeezer includes a wedge-shaped section and may be moved parallel and/or inwardly to the longitudinal axis of the caddy. The toothpaste tube may be easily replaced through a hinged or detachable end cap. A modular and detachable toothbrush mates with the caddy and includes a shaft with a central bore through which toothpaste may be forced by operation of the squeezer. In a preferred embodiment, the toothbrush head includes a plurality of projections adapted to fit into mating slots located on the caddy. Alternative embodiments of mounting the toothbrush head to the caddy, including by reversing the location of the slots and tabs or by providing a plurality of locking shoulders, are described and will be appreciated by persons of skill in the art. A refresh rinse cap cover is further supplied to store and protect the toothbrush while not in use and to serve as a rinse cup post brushing.

BRIEF DESCRIPTION OF THE SEVERAL VIEWS OF THE DRAWING(S)

FIGS. 38-40 are perspective view of a toothpaste squeezer in accordance with aspects of the disclosure.

DETAILED DESCRIPTION OF THE INVENTION

Figures 1, 2, 3:
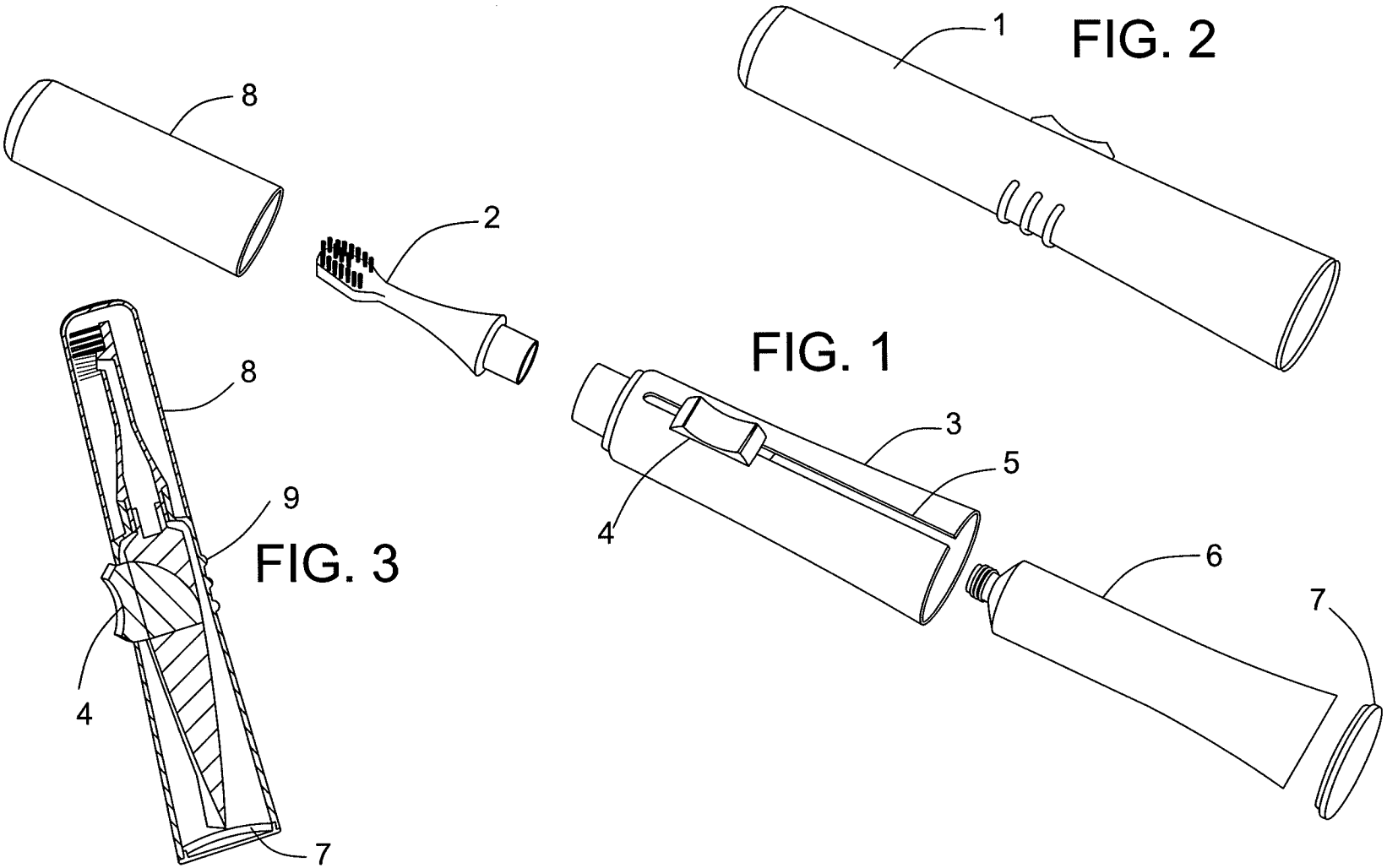
FIG. 1 is a exploded perspective view of certain components of an integrated device in accordance with the disclosure.
FIG. 2 is a external perspective view of an integrated device in accordance with aspects of the disclosure.
FIG. 3 is a cutaway perspective view of an integrated device in accordance with aspects of the disclosure.
Figure 4:
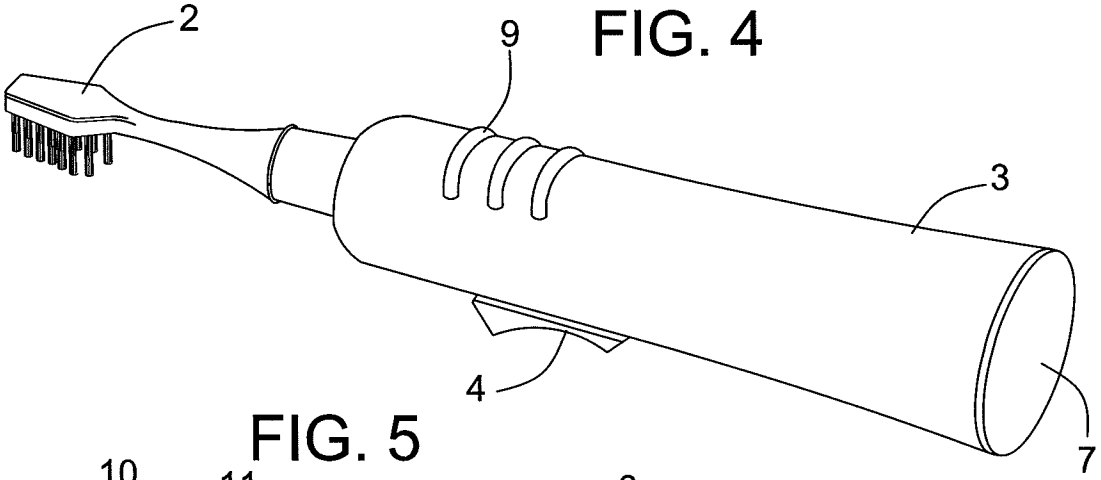
FIG. 4 is an external perspective view of an integrated device in accordance with aspects of the disclosure.

A toothbrush device 1 including a toothbrush head 2, a caddy 3, a toothpaste squeezer 4, an end cap 7 and a refresh cup 8 are illustrated in perspective form in FIGS. 1-4. The device 1 is part of an oral hygiene system that is intended for consumer use. FIG. 1 illustrates several components including a longitudinal slot 5 in caddy 3 that guides a squeezer 4 along a predetermined track. An ordinary toothpaste tube, indicated by reference numeral 6, may be inserted into caddy 3. In addition, a detachable and modular toothbrush head 2 mates with caddy 3. As illustrated in the cutaway view of FIG. 3, the squeezer includes a generally wedge-shaped section and further includes a contoured section that accommodates a thumb or finger. In a preferred embodiment, the caddy 3 further includes grip strips, such as those indicated by reference numeral 9.

Figure 22:
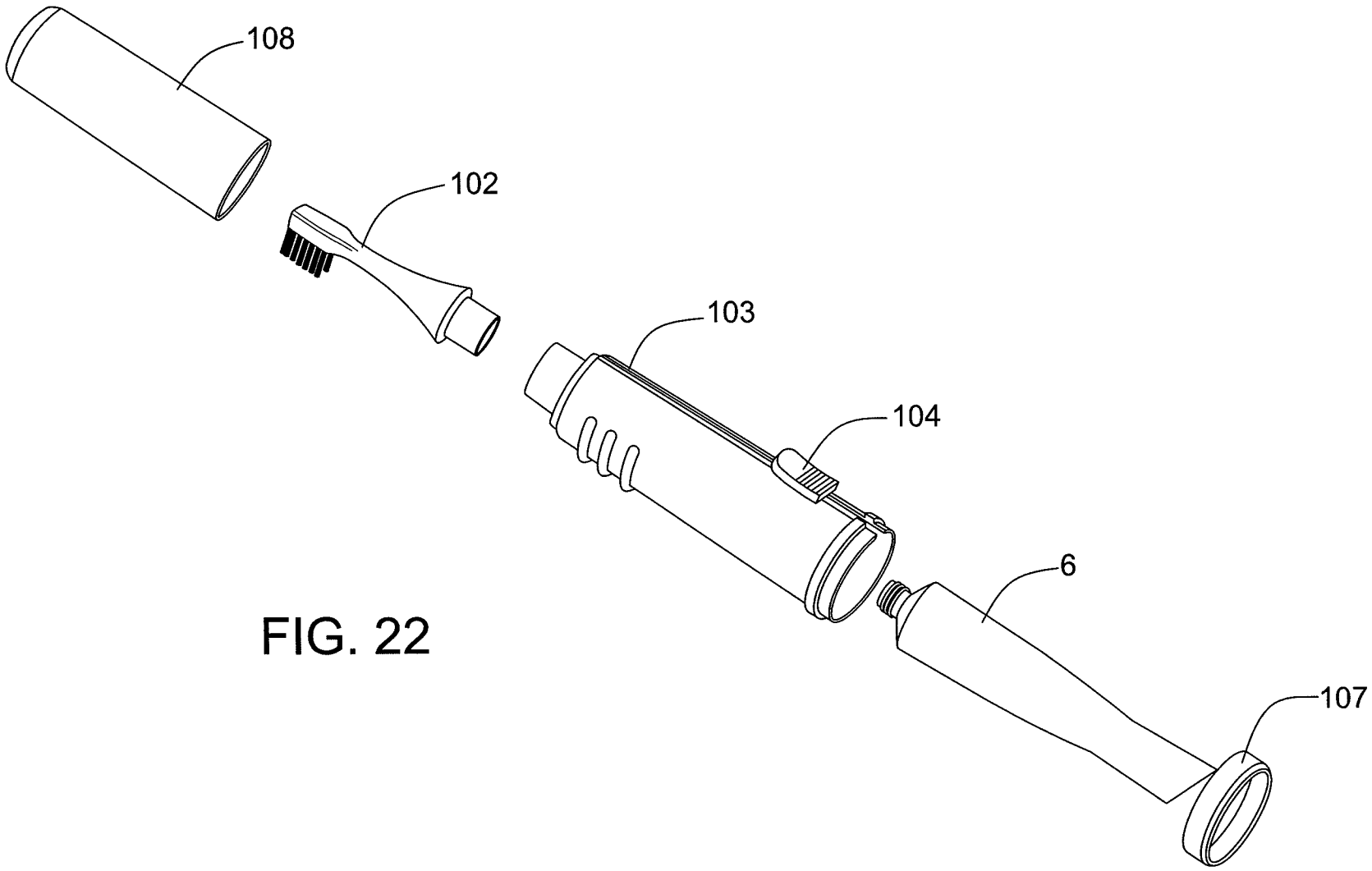
FIG. 22 is a exploded perspective view, similar to FIG. 1, of certain components of an integrated device in accordance with the disclosure.
Figure 24:
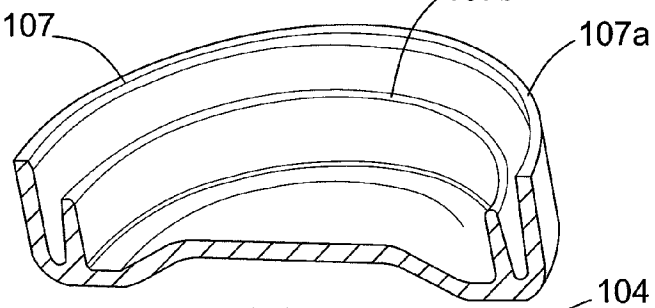
FIG. 24 is also a cutaway perspective view of the end cap of an integrated device in accordance with aspects of the disclosure.
Figure 23:
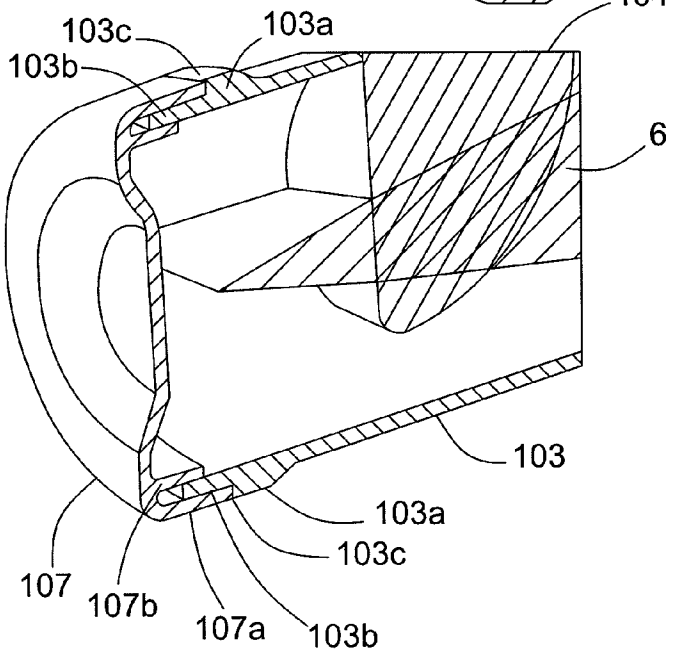
FIG. 23 is a cutaway perspective view of the end cap of an integrated device in accordance with aspects of the disclosure.
Figure 26:
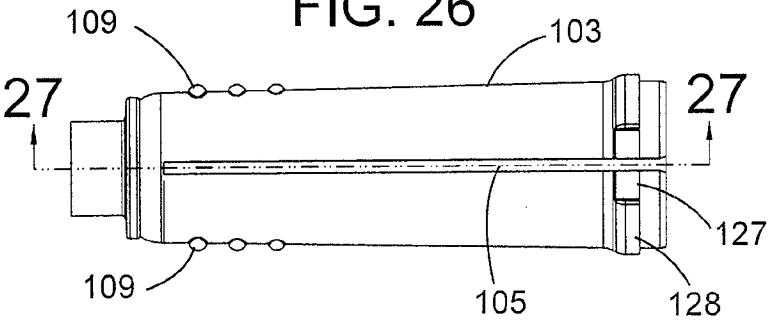
FIG. 26 is a top elevation of a caddy portion of an integrated device in accordance with aspects of the disclosure.

FIGS. 22-24 likewise illustrate perspective views of an alternative embodiment of toothbrush device 101 including a toothbrush head 102, a caddy 103, a toothpaste squeezer 104, an end cap 107 and a refresh cup 108. The device 100 is part of an oral hygiene system that is intended for consumer use. FIG. 22 illustrates several components including a longitudinal slot 105 in caddy 103 that guides a squeezer 104 along a predetermined track 105 (FIG. 26). An ordinary toothpaste tube, indicated by reference numeral 6, may be inserted into caddy 103. The caddy in either illustrated embodiment accepts ordinary toothpaste tubes. Persons of skill in the art will further appreciate that caddy 3 or caddy 103 may be sized to fit smaller or larger "standard" sizes of toothpaste tubes, including travel sizes. As indicated in FIG. 22, a detachable and modular toothbrush head 102 mates with caddy 103. The squeezer 104 includes a generally wedge-shaped section (FIG. 31) and further includes a contoured section that accommodates a thumb or finger (FIG. 22). In a preferred embodiment, the caddy 103 further includes grip strips, such as those indicated by reference numeral 109. The grip strips 109 are generally oriented opposite to the squeezer 104. In the embodiment illustrated in FIG. 22, the strips 109 circumferentially extend more than 180 degrees for enhanced hand traction.

Upon depressing and advancing the squeezer along its track, the toothpaste in the tube 6 is extruded out of the toothpaste tube. A central bore in the toothbrush head 2 (illustrated in FIGS. 13-16) fluidly communicates toothpaste from the toothpaste tube and provides a pathway for the toothpaste to reach bristles on the toothbrush. The toothbrush bristles are preferably attached to the head 2 through in-molded technology.

Figure 5:
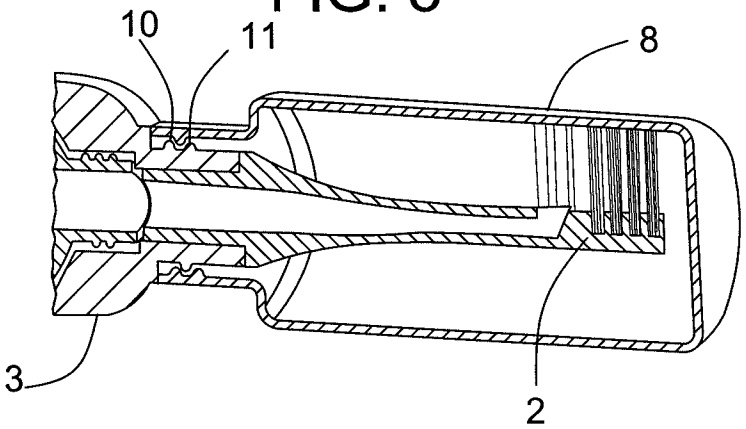
FIG. 5 is an enlarged cutaway perspective view of an integrated device in accordance with aspects of the disclosure.
Figure 6:
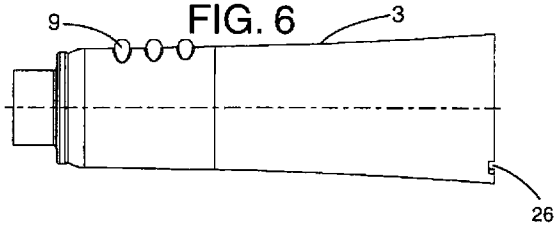
FIG. 6 is a side elevation of a caddy portion of an integrated device in accordance with aspects of the disclosure.
Figure 7:
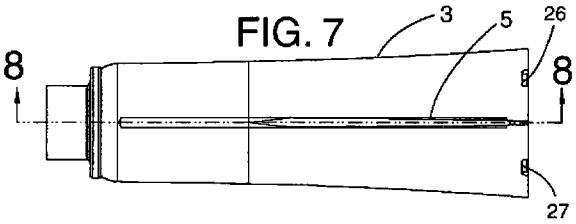
FIG. 7 is a top elevation of a caddy portion of an integrated device in accordance with aspects of the disclosure.
Figure 8:
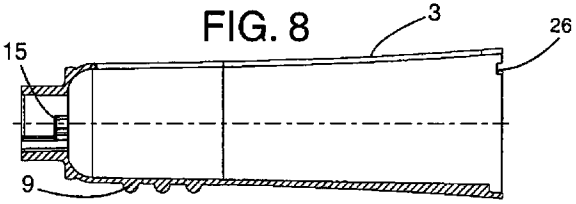
FIG. 8 is a sectional view of a caddy portion of an integrated device in accordance with aspects of the disclosure.

FIG. 5 is an enlarged cutaway view of an end of an assembled integrated tooth brushing device. This view illustrates a toothbrush 2 mated to a caddy 3, wherein the toothbrush is enclosed by a refresh cup 8. The refresh cup 8 preferably snap fits onto caddy 3 thereby allowing ready access to the toothbrush when desired. Cup 8 protects the toothbrush while not in use and further serves as a rinse cup after brushing. In a preferred embodiment, cup 8 is made with antimicrobial materials. An example of this arrangement is illustrated in FIG. 5 in which a caddy 3 includes one or more annular tongues, indicated by reference numeral 10, that press fit into one or more annular groves located on refresh cup 8, which arrangement of tongues and grooves may be reversed. Although illustrated as a snap fit, the refresh cup 8 may be coupled to the caddy 3 through any suitable fastening means.

Figure 9:
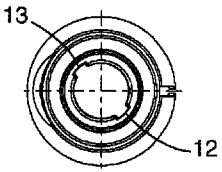
FIG. 9 is an end view of a caddy portion of an integrated device in accordance with aspects of the disclosure.
Figure 9A:
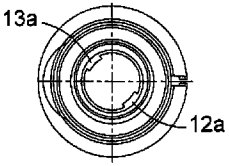
FIG. 9A is an end view of a caddy portion of an integrated device in accordance with aspects of the disclosure and is an alternative embodiment to that illustrated in FIG. 9.
Figure 25:
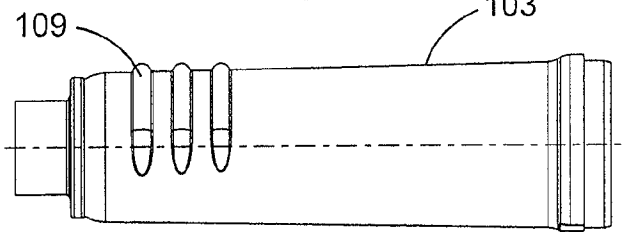
FIG. 25 is a side elevation of a caddy portion of an integrated device in accordance with aspects of the disclosure.
Figure 27:
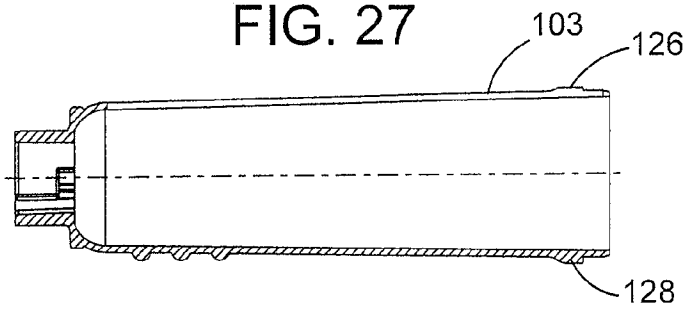
FIG. 27 is a sectional view of a caddy portion of an integrated device in accordance with aspects of the disclosure.
Figure 28:
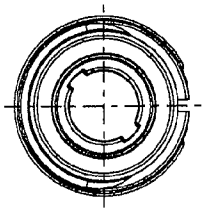
FIG. 28 is an end view of a caddy portion of an integrated device in accordance with aspects of the disclosure.

In preferred embodiments, the caddy 3 accepts an ordinary toothpaste tube. Side, top, sectional and end views of such a caddy are illustrated in FIGS. 6-9, respectively. FIGS. 25-27 likewise illustrate such views in an alternative embodiment. Sectional view FIG. 8 of one embodiment illustrates a sleeve 15 which accepts the threaded end of an ordinary toothpaste tube. Sectional view FIG. 27 likewise illustrates the threaded end of such a toothpaste tube in an alternative embodiment. A toothpaste tube, such as tube 6, is placed into the cavity of caddy 3 or caddy 103. As further indicated by the end view of FIG. 9, the caddy 3 includes slots 12 and 13 for accepting tabs on a toothbrush head. FIG. 9A illustrates an alternative embodiment in which the caddy 3 includes tabs 12*a* and 13*a* for mating with slots on a toothbrush head. FIG. 28 illustrates a similar, but alternative, embodiment of the caddy. The caddy and toothbrush may be made of any suitable material and, in a highly preferred embodiment, are molded using ABS plastic.

Figure 12:
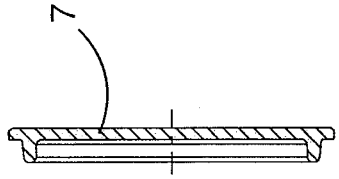
FIG. 12 is a sectional view of an end cap portion of an integrated device in accordance with aspects of the disclosure.
Figure 11:
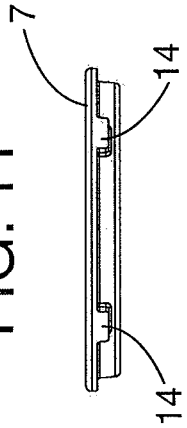
FIG. 11 is a side elevation of an end cap portion of an integrated device in accordance with aspects of the disclosure.
Figure 10:
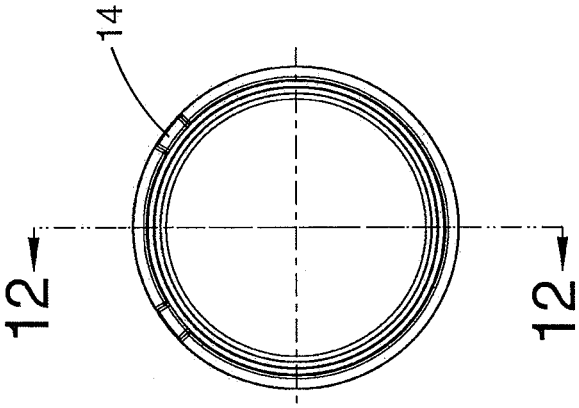
FIG. 10 is an end view of an end cap portion of an integrated device in accordance with aspects of the disclosure.
Figure 14:
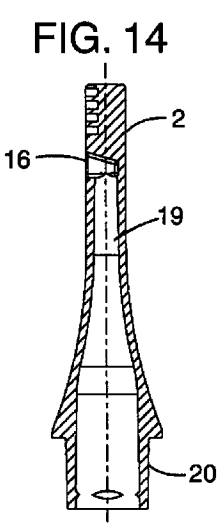
FIG. 14 is a sectional view of a toothbrush portion of an integrated device in accordance with aspects of the disclosure.
Figure 13:
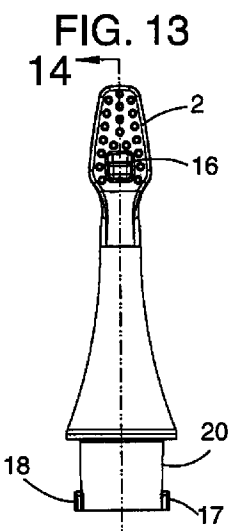
FIG. 13 is a front elevation of a toothbrush portion of an integrated device in accordance with aspects of the disclosure.
Figure 15:
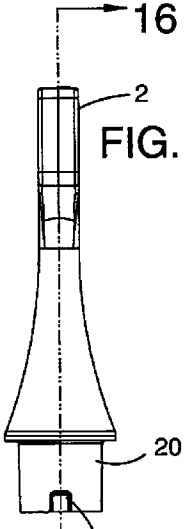
FIG. 15 is a side elevation of a toothbrush portion of an integrated device in accordance with aspects of the disclosure.
Figure 16:
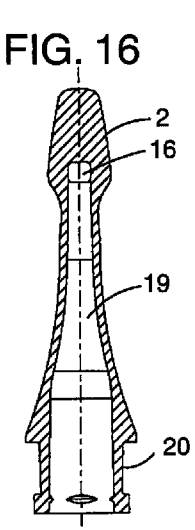
FIG. 16 is a sectional view of a toothbrush portion of an integrated device in accordance with aspects of the disclosure.

An end cap 7 serves to enclose the toothpaste tube in caddy 3. FIGS. 10-12 illustrate a suitable end cap in a preferred embodiment. The end cap 7 includes a plurality of projections, such as indicated by reference numeral 14, that fit into sockets and 27 in caddy 3. The projections 14, in combination with sockets 26 and 27, act as a hinge that allows the end cap 7 to pivot into an open position. After a toothpaste tube is loaded, the end cap 7 may be pivoted back into a closed position. The end cap 7 further may be entirely detachable from the caddy 3.

Figure 30:
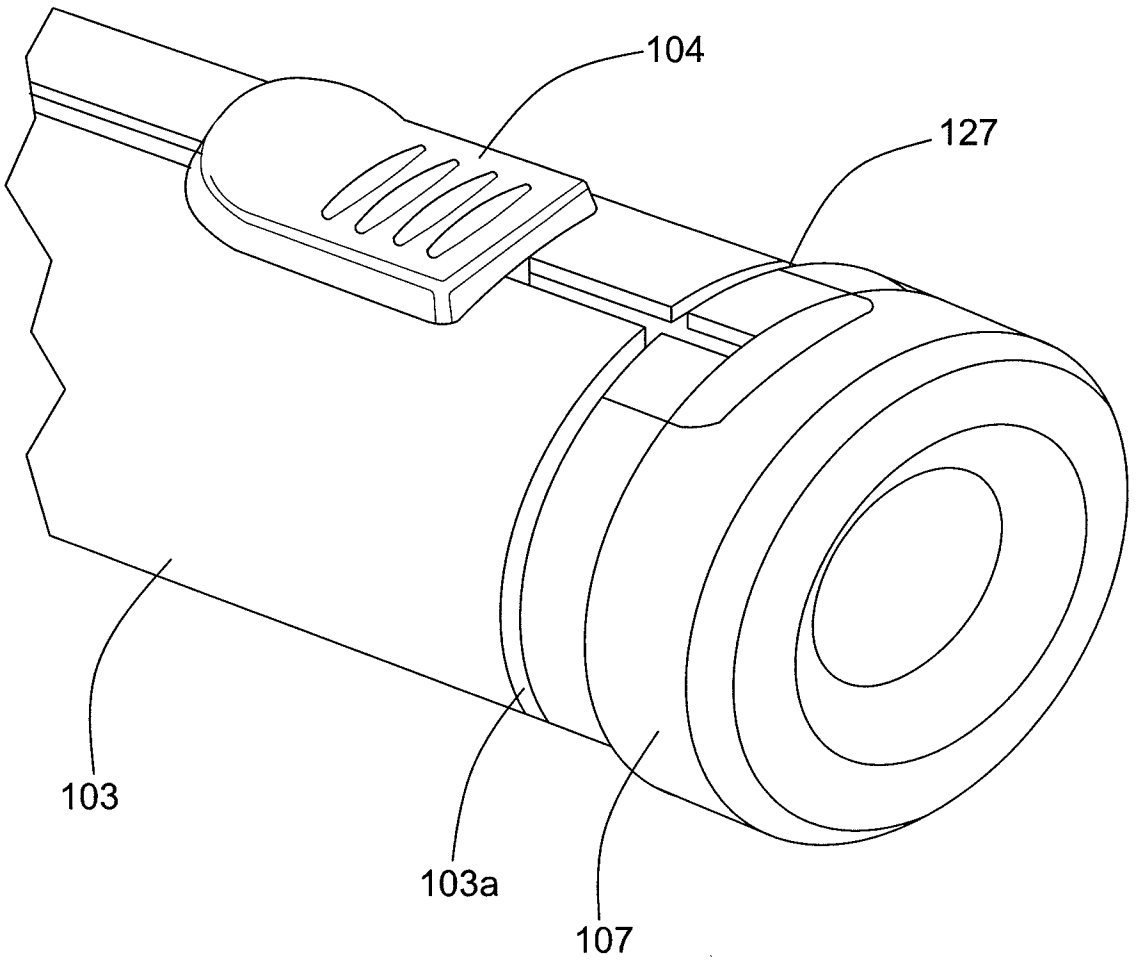
FIG. 30 is a perspective view of the bottom portion of an integrated device in accordance with aspects of the disclosure.

Alternatively, the end cap may be a snap fit design. FIGS. 23-24 and FIG. 30 illustrate such a design. End cap 107 includes annular sections 107*a* and 107*b* that press fit into an annular projection 103*b* in caddy 103 (FIG. 24). Portion 103*a* of the side wall of the caddy 103 is flared to a similar outside dimension of the end cap 107*a*, and further includes a ridge 103*c* that contacts annular section 107*a* as an end stop (FIG. 23). Annular section 107*a* extends in a longitudinal direction beyond annular section 107*b*, which permits section 107*a* to act as a guide for closing end cap 107. Advantageously, annular projection 103*b* may be formed into a wall of caddy 103. The projection may be a constant dimension or may be tapered. If tapered, end cap 107 is increasingly frictionally engaged as it is placed upon caddy 103 until annular section 107*a* contacts ridge 103*c*. FIG. 23 further illustrates toothpaste tube 6 and squeezer 104 in a functional relationship, both of which are located within caddy 103. End cap 107 may be made from a more pliable and elastic material than caddy 103. This permits the end cap to stretch over the projections 103*b* formed in the distal end of caddy 103.

Figure 29:
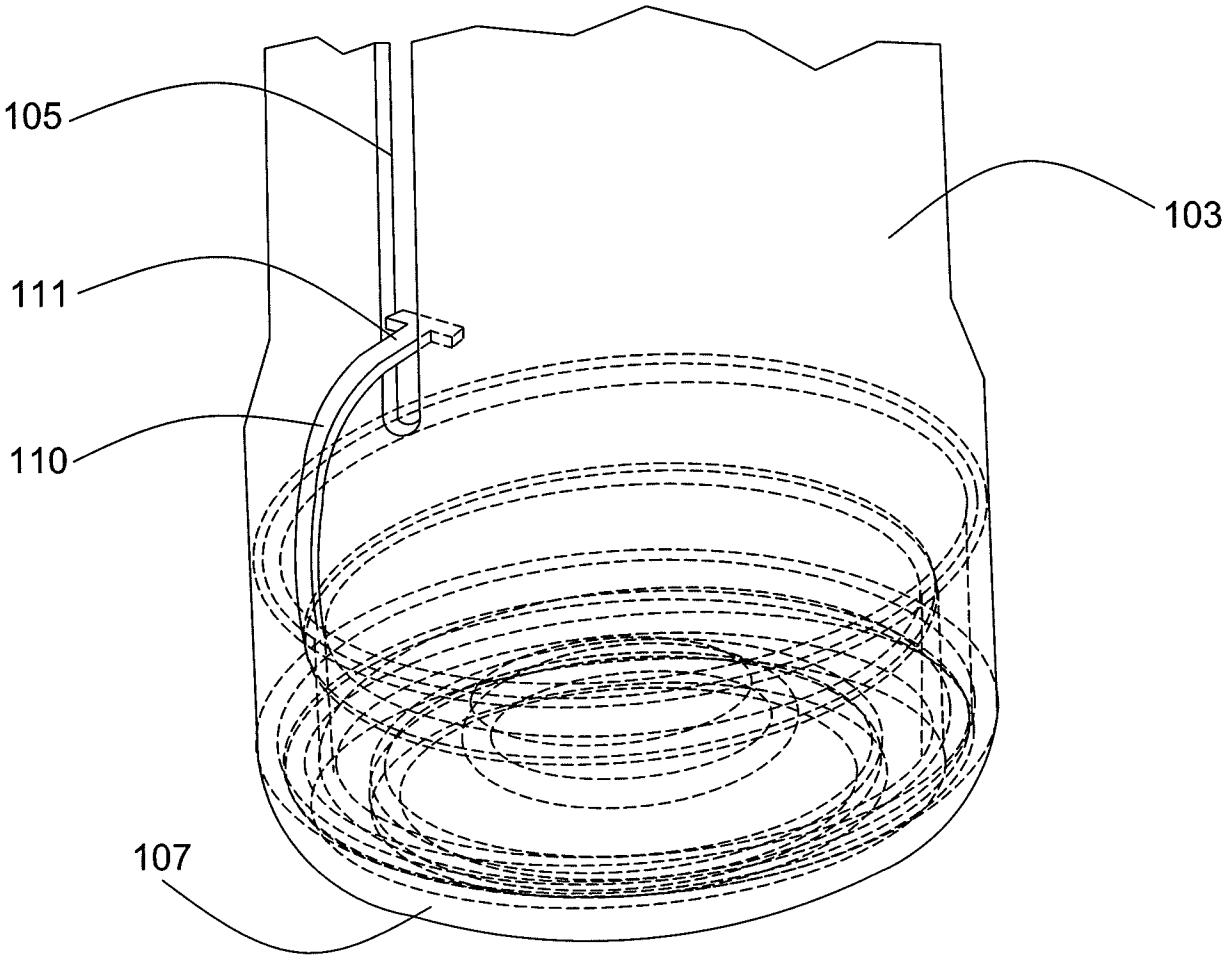
FIG. 29 is a cutaway perspective view of the end cap of an integrated device in accordance with aspects of the disclosure

In yet a further refinement, illustrated in FIG. 29, end cap 107 is tethered to the caddy 103 through a strap 110. In this illustrated embodiment, the strap includes a retaining section 111 that slides into the same slot 105 used by squeezer 104. The strap allows end cap 107 to be separated from, but still tethered to, caddy 103. The strap 111 may be removed from the slot by rotating the retaining section 111, thereby permitting the end cap to be completely detached. A perspective view of the end cap 107 connected with caddy 103 is illustrated in FIG. 30. Notch 127 aligns the caddy 103 with the end cap 107.

FIGS. 13-17 illustrate an example of a toothbrush head 2 or toothbrush head 102. For clarity purposes, these figures illustrate a toothbrush head without bristles. Persons of ordinary skill in the art will appreciate that suitable bristles will be attached to the head through any known techniques, including in-molding technology, such as described by U.S. patent application Ser. No. 12/062,199 to Moskovich et al., filed Apr. 3, 2008, and published as US 2008/0244849 A1, which is hereby incorporated by reference in its entirety.

Figure 17A:
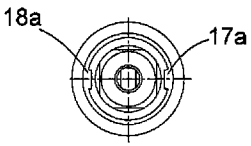
FIG. 17A is an end view of a toothbrush portion of an integrated device in accordance with aspects of the disclosure and is an alternative embodiment to that illustrated in FIG. 17.
Figure 17:
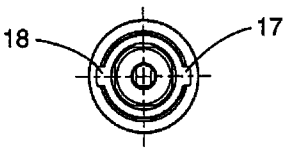
FIG. 17 is an end view of a toothbrush portion of an integrated device in accordance with aspects of the disclosure.
Figure 18:
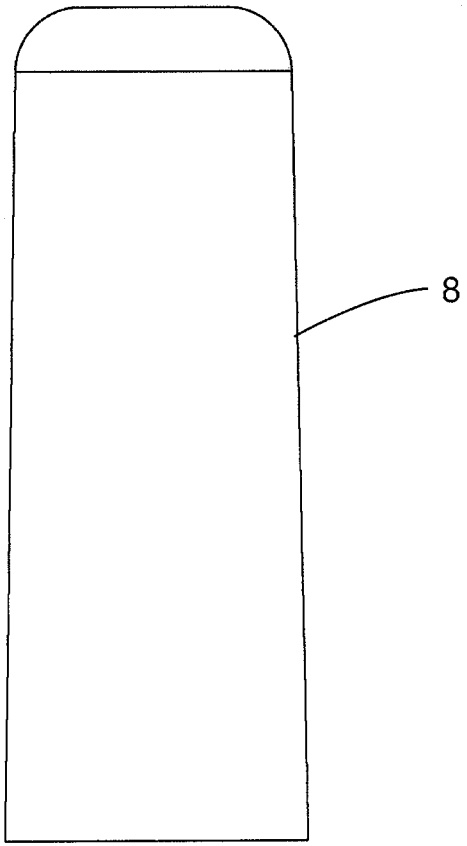
FIG. 18 is a front elevation of a refresh cup cap of an integrated device in accordance with aspects of the disclosure.

In a preferred embodiment, the toothbrush head 2 includes a stem 20 with a hollow portion that defines a channel for the passage of toothpaste from the tube to an area proximate to the bristles. The toothbrush head 2 includes a plurality of projections, indicated by reference numerals 17 and 18, that fit into slots in the caddy 3 or caddy 103, indicated by reference numerals 12 and 13 (FIG. 9). FIG. 17 further illustrates the projections (tabs) on the toothbrush head 2. FIG. 17A illustrates an alternative embodiment in which the toothbrush head includes slots 17*a* and 18*a* that couple with tabs located on the caddy 3 (FIG. 9A). The toothbrush head 2 is preferably modular and detachable, which allows multiple users to hygienically use the same caddy 3. A central bore 19 passes through the toothbrush head 2 and fluidly communicates with the sleeve 15 (FIG. 8) on caddy 3. Pressure caused by contact between the squeezer 4 or squeezer 104 and toothpaste tube 6 causes toothpaste to be extruded and flow through the central bore 19 until reaching an aperture 16 located adjacent to bristles on the toothbrush head 2.

Figure 21:
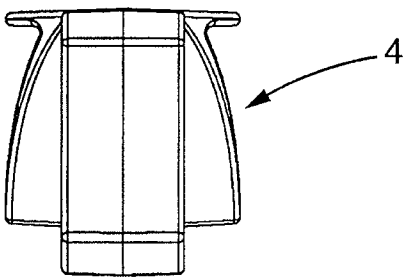
FIG. 21 is a top view of a toothpaste squeezer in accordance with aspects of the disclosure.
Figure 19:
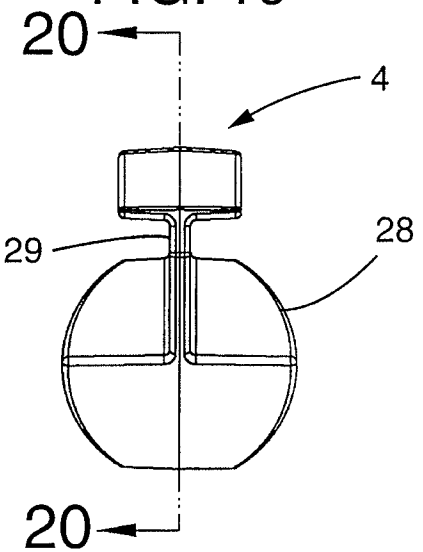
FIG. 19 is a front sectional view of a toothpaste squeezer in accordance with aspects of the disclosure.
Figure 20:
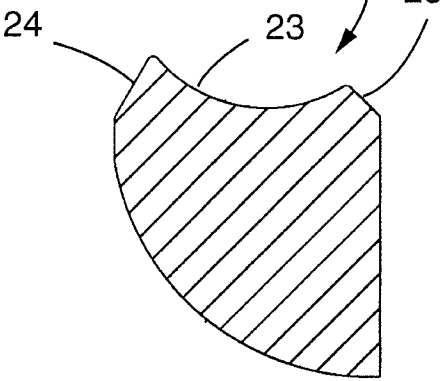
FIG. 20 is a side sectional view of a toothpaste squeezer in accordance with aspects of the disclosure.

An exemplary toothpaste squeezer is illustrated in the front, side and top views of FIGS. 19-21 respectively. The squeezer 4 includes a generally wedge-shaped section and includes a contoured section 23 defined by chamfered sections 24 and 25. It has been experimentally determined that an integrated toothbrushing device with a squeezer of the shape generally illustrated in FIGS. 19-20 more effectively dispenses toothpaste from an ordinary toothpaste tube than other known types.

As readily seen by comparing FIG. 19 to FIG. 1, the squeezer 4 includes a stem portion 29 that fits into a slot 5 in caddy 3. The top contoured section 23 of the squeezer 4 remains external to caddy 3 whereas the lower wedge-shaped portion 28 is located within caddy 3. As the squeezer 4 travels along slot 5 (see FIG. 1), the wedge-shaped section makes contact with the toothpaste tube 6 and extrudes toothpaste from within. The stem portion 29 of the squeezer 4 exceeds the thickness of the wall of the caddy 3, which allows for controlled movement in an axially inward or outward direction. A user may therefore place greater or lesser pressure upon the toothpaste tube by varying the amount of squeezer travel along the track and varying the inward depth of contact with the tube. The design of the squeezer 4 provides additional functional flexibility, including the ability to raise or lower wedge depressor portion of squeezer 4 while traveling along glide track. This permits improved depth contact with toothpaste tube and further facilitates ease in loading toothpaste tube into the caddy opening.

Figure 31:
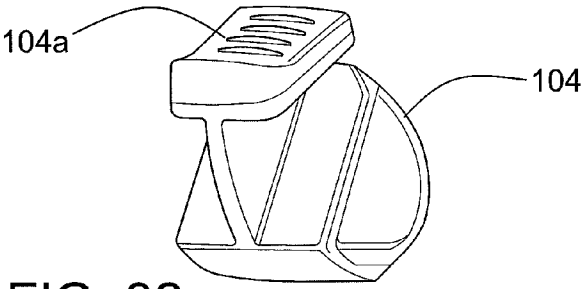
FIG. 31 is a perspective view of a toothpaste squeezer in accordance with aspects of the disclosure.
Figure 32:
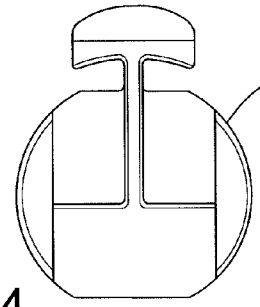
FIGS. 32 and 33 are end views of a toothpaste squeezer in accordance with aspects of the disclosure.
Figure 33:
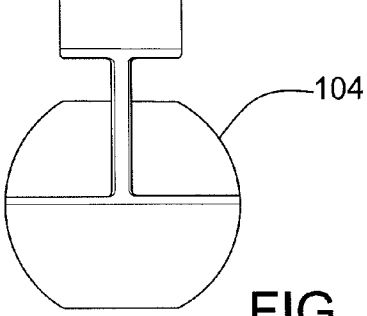
Figure 34:
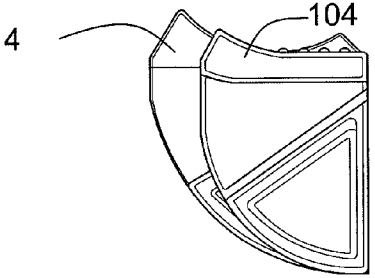
FIG. 34 is a comparison side view of two different toothpaste squeezers made in accordance with aspects of the disclosure.

An alternative squeezer design is illustrated in FIGS. 31-33. This design is smaller than that illustrated in FIGS. 19-21. Either squeezer may be used depending on the application and desired force. The side-by-side comparison of the different squeezers is illustrated in FIG. 34. The squeezer design of FIG. 31 further includes grip strips 104*a*. Such strips also may be utilized in connection with squeezer 4.

As best illustrated in FIGS. 31-33, the wedge shaped portion of squeezer 104 flares in a circumferentially outward direction when viewed from front to back. The leading surface to contact the toothpaste tube is thus reduced in size when compared with the trailing surface. This design enables the squeezer to initially meet with less resistance when extruding toothpaste from the toothpaste tube. The flared trailing surface also advantageously insures that a maximum amount of toothpaste is ultimately extracted from the tube as the squeezer travels down the track along both the longitudinal and transverse axes.

Figure 35:
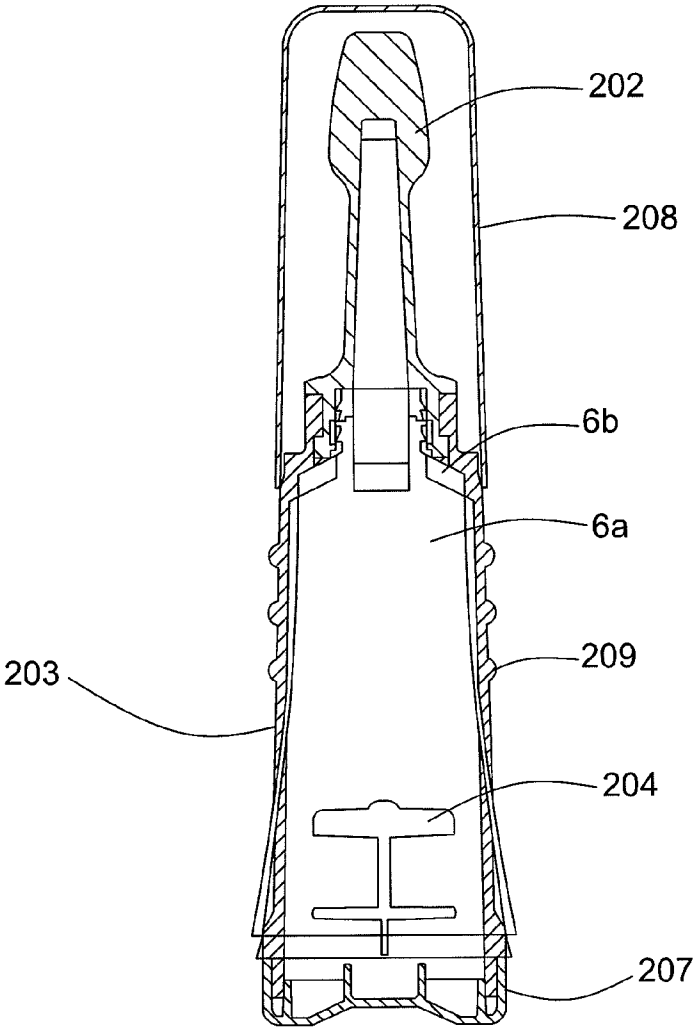
FIGS. 35-37 are cutaway perspectives of an integrated device in accordance with aspects of the disclosure.
Figure 37:
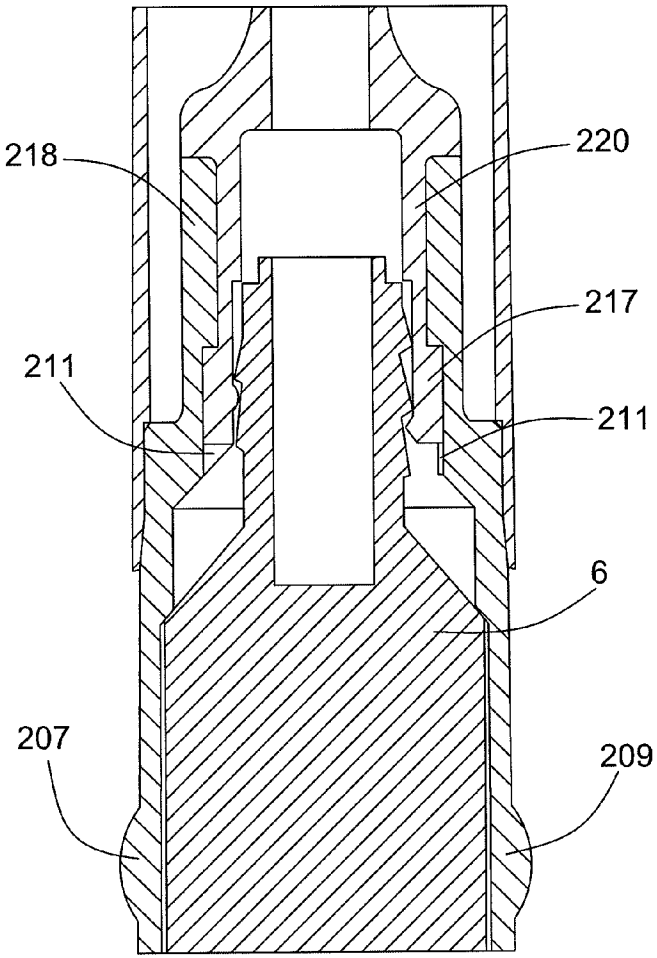
Figure 36:
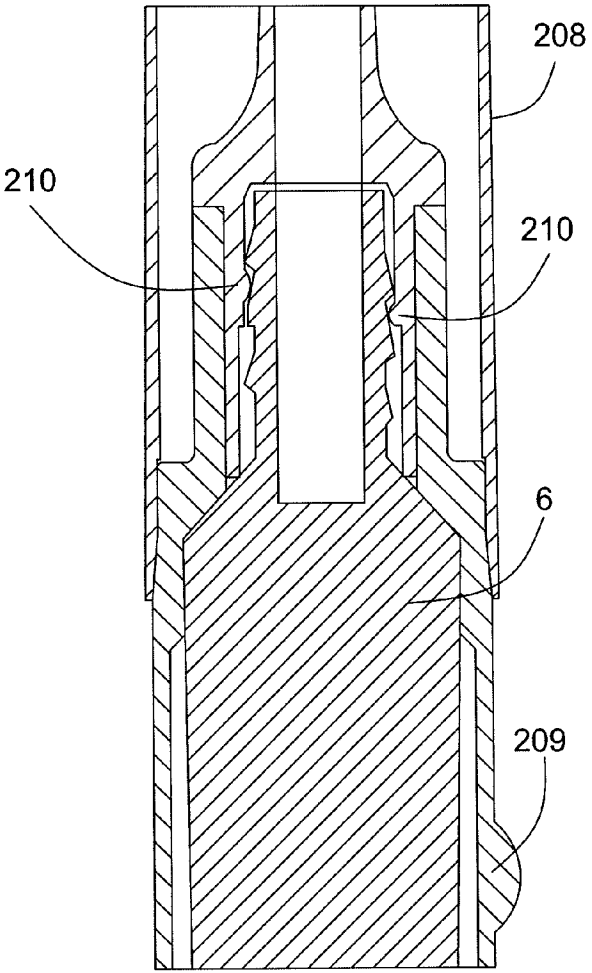

FIGS. 35-37 illustrate yet another embodiment. In one embodiment of the invention, the integrated toothbrush, dispenser, caddy and cap, as measured from the end of refresh cap 208 to the bottom of end cap 207, is approximately 6.765 inches in length, which is suitable for a variety of applications. This length will accommodate a range of standard size toothpaste tubes from 0.75 ounces or 0.85 ounces or 2.7 ounces. The product further may be scaled depending on application, for example to a 9 inch travel size in to accommodate larger toothpaste tube sizes, including the commonly available size of 2.7 ounces. The integrated toothbrush device is designed to accept only a single tube of toothpaste at a time, but FIG. 35 illustrates for exemplary purposes a comparison of two different sizes of toothpaste tubes (6*a* and 6*b*) inside caddy 203. A reduced size unit, including for use by children, may also be appropriately scaled. Based on the materials selected, the caddy, such as caddy 203, will outlast the modular toothbrush heads. In a preferred embodiment, the caddy will tolerate at least four changes in toothbrush heads.

In the embodiment illustrated in FIGS. 36-37, toothbrush head 202 includes detentes 210 and caddy 203 includes detentes 211, which together secure the toothpaste tube when loaded in the cavity. Detentes 210 and 211 interact with, and are positioned to recognize, threads on the tube of toothpaste and thereby tightly couple the inserted toothpaste tube to the toothbrush head and improve optimum dispensing functionality of toothpaste from the tube. The tube may be removed from the head and the caddy by overcoming the resistive force of the detents, including by pulling the tube in an outward direction or through rotations. Detents, such as detent 210, are located on an internal portion of the stem of the toothbrush head. Likewise, reference numeral 211 of FIG. 37 identifies a detent on the caddy for engaging and stopping the travel of a toothpaste tube. Persons of skill in the art will understand that multiple detents in different arrangements are possible.

The embodiment of FIGS. 35-37 further includes a refinement on the toothbrush head 202 and squeezer 204. Toothbrush head 202 includes a stem portion 220 with a shoulder 217. In this embodiment, toothbrush head 202 is inserted into the caddy 203 and then locked in place by rotation. When rotated, shoulder portion 217 of the head 202 contacts a mating shoulder 218 on a wall of caddy 203. Squeezer 204, which is illustrated in cross-section in FIG. 35, has a reduced surface for contacting the toothpaste tube when compared with the squeezers of other embodiments. FIGS. 38-40 further illustrate squeezer 204 in several perspective views, which illustrate novel aspects of this squeezer design, including beveled edges, grip stips 204*a*, and a flared wedge shape design when viewed from front to back. As illustrated in these figures, the wedge shaped section further includes a bottom flat portion 204*b*. The web shaped section of the squeezer includes a rear semicircular section, indicated by surface 204*c* and circumference 204*e*, and a frontward tapering generally triangular cross-section that projects from the rear semicircular section and in which the triangular cross-section is defined by bottom flat portion 204*b*, side 204*d* and surface 204*c*.

Although illustrated in FIG. 1 in an exploded view, the toothbrush system as described above typically will be used by consumers as an integrated unit. A consumer will load an ordinary toothpaste tube into the cavity of the caddy and further mount a toothbrush head. The design of the caddy permits ready assembly and disassembly of the toothbrush head to allow multiple users to conveniently use a single caddy and to replace old nylon toothbrush heads with a new snap-on replacement. By controlling the operation of the squeezer, both along the track and in an axially inward direction, the consumer may dispense a desired amount of toothpaste. Also, the design of the squeezer maximizes the amount of toothpaste to be extruded from the tube, thereby reducing the amount of wasted toothpaste.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. An oral hygiene device comprising:

a detachable toothbrush head having bristles, a central bore, and an aperture adjacent to the bristles and in fluid communication with the central bore;

a toothpaste caddy removably connected with the toothbrush head and including a toothpaste tube cavity capable of receiving different sized toothpaste tubes, an end cover, a sleeve for receiving a toothpaste tube, and a longitudinal track;

a toothpaste tube squeezer coupled to the caddy and having a wedge-shaped portion, a stem portion, and a contoured portion, wherein the squeezer travel is defined by the longitudinal track in a first direction and by the stem portion in a second direction, which squeezer travel in the second direction produces variable pressure upon a toothpaste tube when inserted into the cavity, and wherein the wedge-shaped portion has a rear semicircular section and a front tapering triangular cross-section that projects from the front semicircular section; and a removable cup that encases the toothbrush head and snap fits onto the caddy.

2. The oral hygiene device of claim 1, wherein the stem is longer at the front of the squeezer than at the rear of the squeezer.

3. The oral hygiene device of claim 2, wherein the end cover is detachably coupled to the caddy by a hinge.

4. The oral hygiene device of claim 2, wherein the end cover is detachably coupled to the caddy by a press fit.

5. The oral hygiene device of claim 4, wherein the end cover is tethered to the caddy by a strap.

6. The oral hygiene device of claim 5, wherein the strap is detachable from the caddy.

7. The oral hygiene device of claim 1, wherein the bristles are attached to the toothbrush head through in-molded technology.

8. The oral hygiene device of claim 1, wherein the toothbrush head includes at least one mounting tab and the toothpaste caddy includes at least one slot for receiving the mounting tab.

9. The oral hygiene device of claim 1, wherein the toothpaste caddy includes at least one mounting tab and the toothbrush head includes at least one slot for receiving the mounting tab.

10. An oral hygiene device comprising:

a detachable toothbrush head with a hollow stem that defines a toothpaste channel, wherein an internal portion of the stem includes at least one detent for engaging threads on a toothpaste tube;

a toothpaste caddy removably coupled to the toothbrush head and having a cavity for receiving different sized toothpaste tubes, at least one detent for locating a toothpaste tube, a detachable end cover, and a longitudinal track for guiding a squeezer in a first direction; and a toothpaste tube squeezer coupled to the caddy and having a wedge-shaped portion, a stem portion, and a contoured portion, wherein the squeezer travel is defined by the longitudinal track in a first direction and by the stem portion in a second direction, which squeezer travel in the second direction produces variable pressure upon a toothpaste tube when inserted into the cavity, and wherein the wedge-shaped portion has a rear semicircular section and a frontward tapering triangular cross-section that projects from the front semicircular section.

11. The oral hygiene device of claim 10 further comprising a removable cup that encases the toothbrush head and snap fits onto the caddy.

12. The oral hygiene device of claim 10, wherein the bristles are in-molded to the toothbrush head.

13. The oral hygiene device of claim 10, wherein the end cover is detachably coupled to the caddy by a hinge.

14. The oral hygiene device of claim 10, wherein the end cover is detachably coupled to the caddy by a press fit.

15. The oral hygiene device of claim 14, wherein the end cover is tethered to the caddy by a strap.

* * * * *